US005255851A

United States Patent [19]

Tobler

[11] Patent Number: 5,255,851

[45] Date of Patent: Oct. 26, 1993

[54] DEVICE FOR PRODUCING AND DISPENSING FOAM

[75] Inventor: Viktor Tobler, Oberduernten, Switzerland

[73] Assignee: Supermatic Kunststoff AG, Uster, Switzerland

[21] Appl. No.: 933,934

[22] Filed: Aug. 24, 1992

[30] Foreign Application Priority Data

Aug. 28, 1991 [CH] Switzerland ..... 02527/91

[51] Int. Cl.[5] ..... B05B 7/32

[52] U.S. Cl. ..... 239/343; 239/590.5; 222/190

[58] Field of Search ..... 222/190, 189, 207, 211, 222/402.1; 239/327, 343, 344, 370, 458, 539, 432, 590.5, 590

[56] References Cited

U.S. PATENT DOCUMENTS

| | | | |
|---|---|---|---|
| 4,330,086 | 5/1982 | Nysted | 239/432 |
| 4,432,496 | 2/1984 | Ito | 222/190 X |
| 5,048,750 | 9/1991 | Tobler | 222/190 X |
| 5,139,201 | 8/1992 | De Laforcade | 239/343 |

FOREIGN PATENT DOCUMENTS

WO90/11236 10/1990 PCT Int'l Appl. .
WO91/09682 7/1991 PCT Int'l Appl. .

*Primary Examiner*—Andres Kashnikow
*Assistant Examiner*—Kenneth DeRosa
*Attorney, Agent, or Firm*—Oblon, Spivak, McClelland, Maier & Neustadt

[57] ABSTRACT

Fitted into the neck (14) of a container (16) is a securing part (12), in the central opening (20) of which there is located the mixer part (26) with mixing chambers (38, 40), covered over by a screen-like refining element (48). Arranged on the refining element (48) is a disk-like valve body (58), which interacts with a ring-like valve seat (60). For discharging foam, the actuating element (70) is pressed down, until the stop (78) bears against the counter-stop (78'). As a result, the valve body (58) reaches the open position, with simultaneous bending of the refining element (48), and air is forced through the air passages (32) and liquid is forced through the liquid passage (34) into the mixing chambers (38, 40) by virtue of the positive pressure in the container (16). The foam formed there is refined upon flowing through the refining element (48). On the way to the outlet (92), the defined passage (74), the fins (68, 102), the ribs (72'), the screen (86) as well as chicanes in the annular channel (96) ensure optimum foam formation and retarding of the foam, so that the positive pressure in the container (16) does not drop abruptly when the valve arrangement is opened.

10 Claims, 2 Drawing Sheets

DEVICE FOR PRODUCING AND DISPENSING FOAM

BACKGROUND OF THE INVENTION

1. Field of the Invention

The present invention relates to a container for producing and dispensing foam.

2. Description of the Related Art

Aerosol bottles for spraying a liquid or a foam by spraying by means of propellent gas are known. In the case of these aerosol bottles, a foam mixture of the foamable liquid and liquefied propellant gas is dispensed through an aerosol valve, the propellant gas expanding after leaving the valve causes the foaming of the liquid. For reasons of environmental protection, there is a need to refrain from the use of environmentally harmful propellant gases. Therefore, bottles in which the propellent pressure is produced by means of plunger type air pumps which are integrated in the bottles have already been developed. The spraying of liquid from such bottles can be performed with conventional aerosol valves. On the other hand, dispensing foam from such bottles is extremely problematical, since in the case of such bottles with air pumps, or in the case of compressed-air bottles, the air acting as propellent gas is not liquefied and consequently does not vaporize (expand) upon leaving the aerosol valve to cause the foaming of the liquid.

Devices of the type for producing and dispensing foam for squeeze bottles are known from Applicants own U.S. Pat. No. 5,048,750, which is not admitted as being prior art, except as required under 35 USC 102. In an axial opening of a securing part intended to be arranged on the neck of the bottle there is provided a mixer part, which has a mixing chamber arrangement into which air and liquid passages open out. The air forced in upon squeezing the bottle and the liquid are intermixed in the mixing chamber arrangement, creating an unrefined foam. In a screen-like refining element, the unrefined foam is refined and conveyed through a channel arrangement to an outlet. Apart from the axial opening, the securing part has openings for secondary air, which is sucked in from the surroundings when the compressed bottle reverts to its original shape. The channel arrangement conveying the foam from the mixer part to the outlet is arranged in a cap which covers the securing part and in which a further channel arrangement for the secondary air is provided. The cap is rotatably mounted between an open position and a closed position in a nut-like manner on a thread of the securing part. In the closed position, a tubular valve body arranged on the cap engages in a valve seat which is on the securing part and formed at the end of a tube intended for conveying the foam, in order to prevent the escape of foam. By turning the cap into the open position, the valve body frees an annular gap-like passage between itself and the valve seat, in order to allow the foam to flow out upon subsequent compressing of the bottle. On the cap there is provided a further closure body, in order to prevent the entry of secondary air into the bottle in the closed position. In the case of this known device, to produce and dispense foam the cap is first turned from the closed position into the open position when the bottle is not pressurized and then the foam is produced and dispensed by compressing the bottle or by pumping air into the bottle. In this process, the forming of the foam is ended by no further compressing of the bottle, or by no further pumping in of air. If after dispensing one or more times no more foam is required, the cap can be turned back to the closed position in order to close the channel arrangement and the opening for secondary air. The known device is not intended, and not suitable, for containers which are put under pressure by means of pumping prior to the removal of foam or are constantly under pressure.

SUMMARY OF THE INVENTION

It is therefore an object of the present invention to provide a foam dispensing device which, with a simple design, is suitable for producing and dispensing foam from containers which are permanently under pressure or which are put under pressure prior to the removal of foam, by use of a gas which is not harmful to the environment, in particular air, as the propelling agent.

The above and other objects are achieved by the device of the present invention in which a foam is produced and dispensed from a container having a neck and holding a foamable liquid, and being able to hold a gas under pressure. A securing part is fixed to the neck of the container and defines an axial bore extending therethrough. A mixture part is fitted in the axial bore and defines a gas passage and a liquid passage connected in parallel and leading from the interior of the container. A mixing chamber arrangement is positioned downstream of the gas and liquid passages such that the gas and foamable liquid from the container may be mixed therein to form the foam. A valve seat is positioned adjacent the mixing chamber arrangement. A valve body is positioned upstream of the valve seat in a foam flow direction. An actuating element is engageable with the valve body to separate the valve body from the valve seat and so form a limited gap therebetween. A screen like refining element is positioned between the mixing chamber arrangement and the valve body to refine the foam prior to reaching the gap between the valve body and the valve seat and a channel arrangement is positioned downstream of the refining element for conveying the refined foam to an outlet. Flow retarding means are provided in the channel arrangement for retarding the flow of foam to the outlet.

In order to avoid the rapid escape of air from the pressurized container and the associated rapid loss of pressure, there are provided chicanes in the channel arrangement, by which the flow rate of the foam is retarded. The foam itself is used as a "plug", in order to reduce the discharge of the compressed air. Provided for the same purpose are limiting means, which fix the open position of the valve arrangement in such a way that the annular gap-shaped passage between the valve seat and the valve body is so small that the amount of air flowing out is restricted, but is at least great enough for the foam produced not to be destroyed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
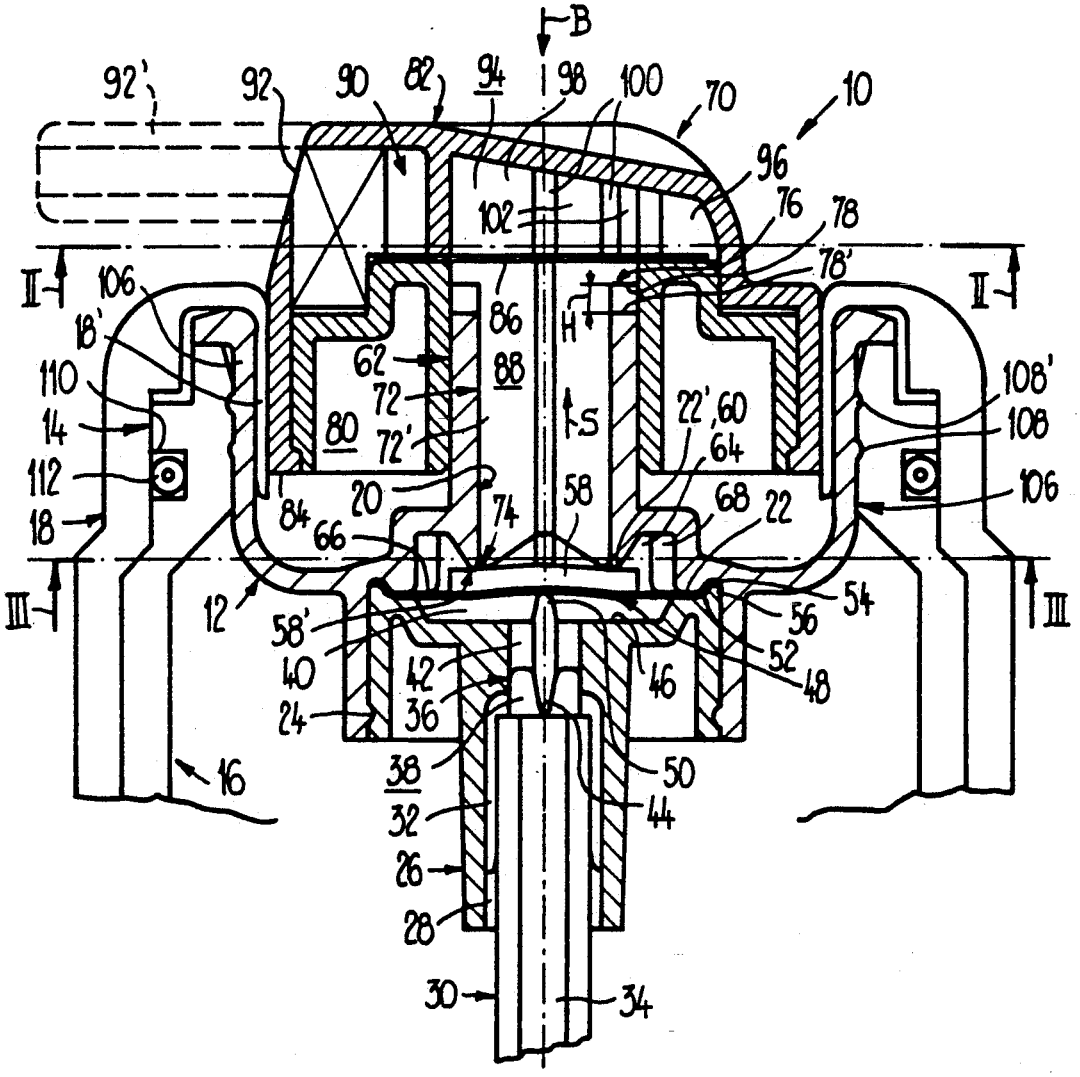
FIG. 1 shows an axial section through a device according to the invention.

The device 10 for producing and dispensing foam has a securing part 12, which is fitted in a plug-like manner into a neck 14 of a container 16, for example a plastic bottle, and is fastened pressure-tightly thereto by means of a union nut 18. In this securing part 12 there is provided an axial bore 20 which is essentially axially symmetrical about its axis and has two shoulders 22, 22'.

A mixer part 26 is press fitted into this bore 20 by means of a collar/annular groove snap connection 24. This mixer part 26 has a bore 28 which is ribbed in the longitudinal direction, into which the end of a tube 30 is inserted in such a way that it is firmly held by the vertices of the ribs of the bore 28. Consequently, there is produced between the outside of the tube 30, which reaches approximately to the bottom (not shown) of the container 16, and the inside of the bore 28, a ring of air passages 32, which ring is coaxial with the continuous liquid passage 34 in the tube 30.

In the mixer part 26 there is provided a mixing chamber arrangement 36 with two mixing chambers 38, 40 arranged one behind the other, i.e., with the mixing chamber 40 downstream from the mixing chamber 38. The air and liquid passages 32, 34 open out into the first mixing chamber 38, which is a swirl chamber due to angled vanes extending radially from a central displacement body 44 and this displacement body, and the mixing chamber 38 is flow-connected to the second mixing chamber 40 via a passage 42 which runs in an axial direction and forms the end of the bore opening 28. The passage 42 is arranged in the form of a ring of passages around the central displacement body 44 so that the cross-section of the bore 28 is restricted. The displacement body 44 has a lower end which projects conically towards the tube 30 and the vanes extending therefrom provide a good swirling of the fed-in liquid and air.

The mixer part 26 has on its end face facing away from the tube 30 an offset recess 46, into which the passages 42 open out and which is covered over by a screen-like refining element 48. This recess 46 forms the second mixing chamber 40, into which there protrudes a cone-like supporting member 50 which is formed by the displacement body 44 and is of a truncated design at its tip. The refining element 48 rests centrally on this supporting member 50. It is circumferentially clamped in a peripheral clamping gap 52 formed by the end face of the mixer part 26 and the first shoulder 22 of the securing part 12. The first shoulder 22 is undercut at 54, and axially projecting into this undercut 54 is a peripheral bead 56 of the end face of the mixer part 26, so that the refining element 48 which is bent in the edge region and engages in the undercut 54 is firmly held. The refining element 48 serves to refine the unrefined foam formed in the mixing chambers 38 and 40.

Figure 3:
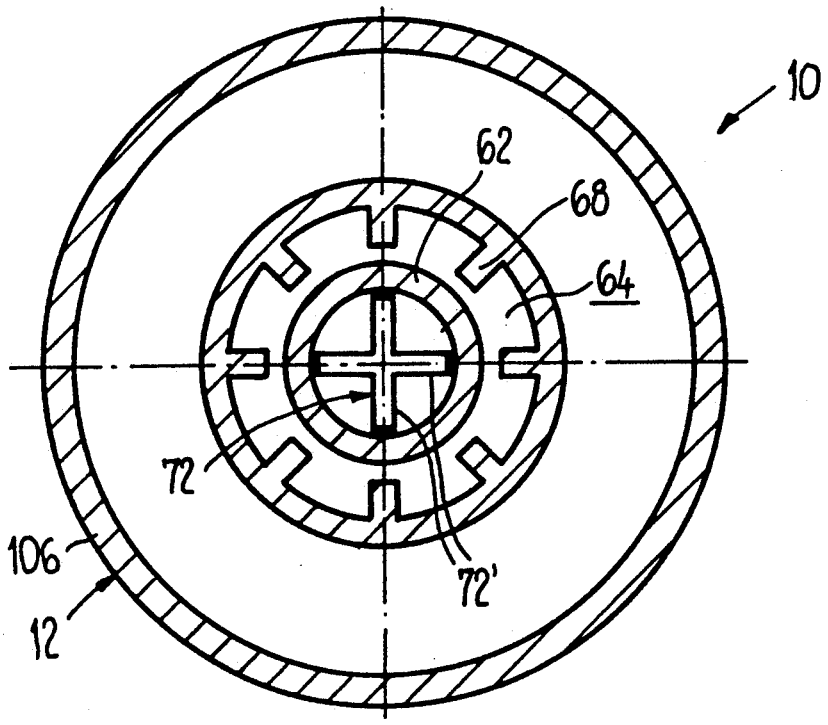

The refining element 48, peripherally clamped and centrally supported by the supporting member 50 is elastically deformable and supports, on the downstream side, i.e., that facing away from the second mixing chamber 40, a disk-like, deformable valve body 58. This valve body 58 interacts with a ring-like valve seat 60 which is formed onto the lower face end of a tube-like wall part 62 of the securing part 12, through which the axial bore 20 extends. This valve seat 60 forms the second shoulder 22', which is likewise undercut and thus bounds an annular space 64 which encloses the valve body 58 and the valve seat 60 and is in communication with the second mixing chamber 40 through an annular disk-like passage region 66 in the refining element 48. Rib-like fins 68 project into the annular space 64 in order to achieve a further refining of the foam and at the same time form a first chicane, in order to retard the outflow rate of the foam flowing in the direction of arrow S (see also FIG. 3). These fins 68 also serve to center the valve body 58.

An actuating element 70 is guided displaceably in axial direction on the tube-like wall part 62 of the securing part 12. The actuating element 70 has a cross-sectionally cruciform actuating member 72 which extends through the wall part 62 in longitudinal direction, is guided slidingly by the radial ends of its ribs 72' on the inner wall of the wall part 62 and is of concave design at the end facing the valve body 58, so that it bears against the valve body 58 only with a region of the ribs 72, neighboring the wall part 62. when the actuating member 72 is displaced against the outflow direction, i.e., in actuating direction B, the valve body 58 is consequently radially distorted out of the closed position shown in FIG. 1 and around the supporting member 50 into an open position. The opening stroke H, and consequently the width of the annular passage 74 bounded by the valve seat 60 and valve body 58, is fixed by bounding means 76 which act in the axial direction and are formed by a stop 78, formed onto the ribs 72', and the end of the wall part 62, interacting therewith as counterstop 78'.

Formed onto the actuating member 72 is a U-shaped ring part 80 whose inner wall bears slidingly against the outer wall of the wall part 62. The ring part 80 is open in the direction of the securing part 12 (i.e., at its bottom) and, together with the actuating member 72, is shrouded in a hat-like manner by an actuating head 82. The actuating head 82 is fastened to the ring part 80 by means of a collar/annular groove connection 84.

On the side facing away from the valve body 58, the actuating member 72 is covered over by a screen 86, which bears against the end face of the ring part 80 and is firmly clamped between the latter and the actuating head 82. The ribs 72' of the actuating member 72 form chicanes in a first channel part 88 of a channel arrangement 90, which conveys the foam from the valve arrangement 58' formed by the valve seat 60 and valve body 58 to an outlet 92 provided on the actuating head 82. This first channel part 88 consequently extends from the valve seat 60 to the screen 86 and is bounded circumferentially by the wall part 62 and the ring part 80. This screen 86 further refines the foam and has a retarding effect on the latter.

Figure 2:
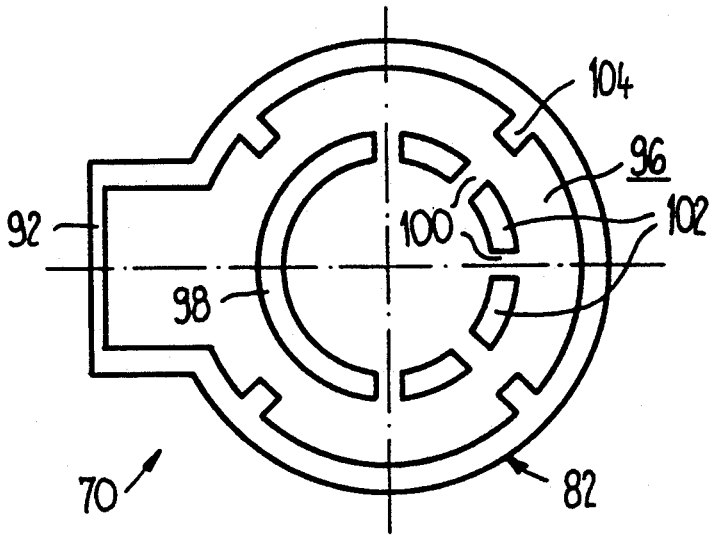
FIGS. 2 and 3 show cross-sections along the lines II—II and III—III of FIG. 1.

Provided in the actuating head 82 is an approximately cylindrical hollow space 94, which is in connection with the channel part 88 through the screen 86 and which is enclosed by an annular channel 96 (FIG. 2), which opens out into the outlet 92. The hollow space 94 and the annular channel 96 are further parts of the channel arrangement 90. The common wall 98 of the annular channel 96 and hollow space 94 has on the side facing away from the outlet 92 a plurality of outflow openings 100, which are separated from one another by fins 102, acting as chicanes. The foam flowing through the screen 86 in flow direction S into the hollow space 94 finds its way through these outflow openings 100 into the annular channel 96 and through the latter to the outlet 92. Due to the arrangement of the outflow openings 100 exclusively on the side facing away from the outlet 92 and the fins 102, the foam is further retarded and forced to flow through the entire annular channel 96. In order to achieve a still further retarding effect on the foam, rib-like chicanes 104 project into the annular channel 96.

For the sake of completeness, it should be mentioned that the screen 86 is pressed by the wall 98 against the end face of the ring part 80. As indicated by dashed lines in FIG. 1, an outlet branch 92' can be formed onto the actuating head 82, so that the outlet is shifted further outwards in the radial direction. If appropriate, a cannula may be fitted onto this outlet branch 92', in order to deliver the foam to poorly accessible localities.

It is to be noted that chicanes and parts acting as chicanes are arranged along the entire channel arrangement 90, in order to retard the foam and, as a result, slow the pressure loss in the container 16.

The securing part 12 has a flange part 106, which encloses the actuating head 82 and is formed with peripheral sealing beads 108, 108' which bear sealingly against the neck 14 of the container 16. The free end region of the flange part 106 is bent radially outwards and bears against the end of the neck 14. The union nut 18 engages over the neck 14 and the flange part 106 and extends as a tube-like flank 18' into the gap between the flange part 106 and the actuating head 82, in order to hold the flange part 106 by its sealing beads 108, 108', and consequently the securing part 12, tightly onto the neck 14 in the axial and radial directions. To assist the tight securing, the union nut 18 interacts with a seal 112 in the form of an O-ring arranged in a circumferential groove 110 of the neck 14.

All the parts of the device 10 with the exception of the screen-like refining element 48 and screen 86 are produced from plastic. Assembly is extremely simple: the refining element 48 can be laid in the axial bore 20 in the securing part 12 and then fastened by means of the mixer part 26, likewise fitted into the bore 20, the collar-/annular groove snap connection 24 snapping in automatically. Then, the securing part 12 with the mixer part 26 assembled on it is introduced into the neck 14 of the container 16 until the bent end region of the flange part 106 bears against the free end of the neck 14; in this process, the two sealing beads 108, 108' come to bear against the flat inner wall of the neck 14. By screwing the union nut 18 onto a thread (not shown) of the container 16, the securing part 12 is fastened on this container 16. For assembly of the actuating element 70, the screen 86 is laid in the actuating head 82 and the actuating member 72 is introduced with the ring part 80 into the actuating head 82 until the collar/annular groove connection 84 snaps in. The thus preassembled actuating element 70 is fitted onto the securing part 12, the actuating member 72 being introduced into the wall part 62. The actuating element 70 is held on the securing part 12 only by the friction between the actuating member 72 and the ring part 80 on the wall part 62 and the friction between the actuating head 82 and the flank 18' of the union nut 18.

The operating principle of the device 10 for producing and dispensing foam is as follows:

The container 16, partially filled with foamable liquid, is put under pressure by air being pumped into the container 16, for example by means of a pump which is not shown but is generally known, integrated on the container 16. The pressure achieved thereby is preferably $3 * 10^5$ Pa to $7 * 10^5$ Pa (equal to 2–6 atmospheres). Smaller pressures are also possible, the foam can be produced at pressures as low as at about $1.2 * 10^5$ Pa (0.2 atmosphere). Since the valve body 58 is arranged upstream of the valve seat 60, the valve body is forced by the positive pressure inside the container 16 against the valve seat 60. Even if there is no positive pressure in the container 16, the valve body 58 is held in the closed position, bearing against the valve seat 60, by its own flexibility and the flexibility of the refining element 48, by virtue of the central support afforded by the supporting member 50 and the peripheral securing of the refining element 48 in the securing part 12. In this position, no air and no foam can escape from the container 16, so that the positive pressure is maintained.

To remove foam, the actuating element 70 has to be pressed down in actuating direction B until the stop 78 comes to bear against counter-stop 78'. By virtue of this actuating stroke H of the actuating member 72, the valve body 58 is bent downwards into its open position, together with the refining element 48 in the region of the ring-like valve seat 60, as a result of which the passage 74 is opened. By virtue of the positive pressure in the container 16, liquid is forced through the liquid passage 34 in the tube 30 and air is forced through the air passages 32 in the bore 28, and into the first mixing chamber. In this first mixing chamber 38, a premixing of the liquid with the air is performed, which is assisted by the vanes of the displacement body 44 as well as the radial inward outflow direction of the air exiting passages 32 and the axial outflow direction of the liquid exiting passage 34.

By this process, unrefined foam is produced, which is forced through the passage 42 into the second mixing chamber 40 and is further developed and refined as a result. In the passage region 66, the unrefined foam is conveyed through the screen-like refining element 48 into the annular space 64, as a result of which the unrefined foam is refined to form a fine foam. The fine foam then flows through the open passage 74 between the valve seat 60 and the valve body 58 without being destroyed in the process and is forced through the channel part 88 to the screen 86 and through the latter into the hollow space 94. The screen 86 helps promote further refining of the foam and at the same time retards its motion. The fine foam is subsequently conveyed from the hollow space 94 through the outflow openings 100 into the annular channel 96, where the foam is retarded by further chicanes 104 and conveyed to the outlet 92.

In addition to the screen 86, the refining element 48, the fins 68 in the annular space 64, the ring-like passage 74, the ribs 72' of the actuating member 72 and the deflections, the fins 102 and fins or chicanes 104 in the region of the actuating head 82 have a retarding effect on the foam flowing out. Under given pressure conditions, the retarding of the foam permits optimum foam forming and at the same time prevents a rapid drop in the pressure within the container 16. This prevents the foam from spraying out of the outlet 92, instead of simply flowing out of it.

As soon as the desired amount of foam has flowed out, the actuating element 70 is released, as a result of which the valve arrangement closes automatically by the valve body 58 moving towards the valve seat 60 and being pressed against it by virtue of its own prestressing and the prestressing of the refining element 48 as well as the difference between the pressure on the upstream side and downstream side on the active surface of the valve body 58. The actuating element 70 is automatically moved along as well.

It is also possible to use a different gas instead of air. It is, of course, also conceivable to produce the container and the securing part from thinwalled metal, similarly to the case of known aerosol bottles, and to fasten them to each other in a flange-like manner. If appropriate, the screen 86 can be dispensed with; in this case, it is possible to design the actuating element in one piece.

Obviously, numerous modifications and variations of the present invention are possible in light of the above teachings. It is therefore to be understood that within the scope of the appended claims, the invention may be practices otherwise than as specifically described herein.

What is claimed as new and desired to be secured by Letters Patent of the United States is:

1. A device for producing and dispensing a foam, comprising:

a container having a neck and holding a foamable liquid, and being able to hold a gas under pressure;

a securing part fixed to the neck of the container and defining an axial bore extending therethrough;

a mixture part fitted in said axial bore and defining a gas passage and a liquid passage connected in parallel and leading from the interior of the container;

a mixing chamber arrangement positioned downstream of the gas and liquid passages in a flow direction such that the gas and the foamable liquid from the container may be mixed therein to form a foam;

a valve seat adjacent said mixing chamber arrangement;

a valve body positioned upstream of said valve seat in a foam flow direction;

an actuating element engageable with said valve body to separate said valve body from said valve seat and to form a gap therebetween;

limiting means for limiting a size of said gap;

a perforate refining element positioned between said mixing chamber arrangement and said valve body, whereby the foam is refined thereby, prior to reaching the gap between said valve body and said valve seat;

a channel arrangement downstream of said refining element for conveying the refined foam to an outlet; and flow retarding means in said channel arrangement for retarding the flow of foam to the outlet.

2. The device of claim 1, wherein said valve body has a disc shape and said refining element comprises a deformable screen held circumferentially in said securing part and elastically pressing said valve body onto said valve seat, said screen having a larger diameter than said valve body so as to define an annular region of the screen through which the foam can flow, and further flow retarding means at a downstream side of said annular region.

3. The device of claim 2, including a support member bearing on a central portion of the valve body and pressing said central portion against said valve seat, and wherein said actuating element engages with a region of said valve body which is radially outside of the central portion, whereby said gap is deformed by radial distortion of said valve body.

4. The device of claim 3, wherein the mixing chamber arrangement comprises two mixing chambers connected to one another by a plurality of passage openings defining a cross-sectional restriction, and a central displacement body around which said passage openings are arranged, said support member being formed as one piece with said central displacement body.

5. The device of claim 3, wherein said channel arrangement includes a tubular wall part through which said actuating element extends, said actuating element having radial ribs comprising a portion of said flow retarding means.

6. The device of claim 5, wherein said actuating element further comprises a tubular actuating head forming a downstream portion of the channel arrangement.

7. The device of claim 6, wherein said actuating head has a ring part which bears circumferentially on the tubular wall part, including a screen like retarding member covering said ring part and traversing said channel arrangement.

8. The device of claim 6, wherein said actuating head comprises an upstream hollow space and a downstream annular channel having the outlet, the hollow space and annular channel being separated by a common separating wall having connecting openings located opposite the outlet.

9. The device of claim 8, including fins extending into the annular channel and comprising a portion of the flow retarding means.

10. The device of claim 9, wherein said limiting means comprise engageable stops on said actuating element and said wall part.

* * * * *